US006306048B1

(12) United States Patent
McCabe et al.

(10) Patent No.: US 6,306,048 B1
(45) Date of Patent: Oct. 23, 2001

(54) GOLF CLUB HEAD WITH WEIGHT ADJUSTMENT

(75) Inventors: Terrill R. McCabe; Jose Perez, both of Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/235,805

(22) Filed: Jan. 22, 1999

(51) Int. Cl.[7] ..... A63B 53/04

(52) U.S. Cl. ..... 473/333; 473/335; 473/338; 473/339; 473/345; 473/349

(58) Field of Search ..... 473/324, 330, 473/331, 332, 333, 334, 335, 336, 337, 338, 339, 340, 345, 346, 347, 348, 349, 350

(56) References Cited

U.S. PATENT DOCUMENTS

| | | |
|---|---|---|
| 645,944 | 3/1900 | Dalgleish . |
| 942,353 | 12/1909 | Rigden . |
| 985,194 | 2/1911 | McLaren . |
| 1,133,129 | 3/1915 | Govan . |
| 1,167,106 | 1/1916 | Palmer . |
| 1,167,387 | 1/1916 | Daniel . |
| 1,213,382 | 1/1917 | Kent . |
| 1,289,192 | 12/1918 | Klin . |
| 1,306,029 | 6/1919 | Robertson . |

(List continued on next page.)

FOREIGN PATENT DOCUMENTS

| | | |
|---|---|---|
| 105959 | 12/1938 | (AU) . |
| 0 786 271 | 7/1997 | (EP) . |
| 346671 | 4/1931 | (GB) . |
| 347502 | 4/1931 | (GB) . |
| 398643 | 9/1933 | (GB) . |
| 413024 | 7/1934 | (GB) . |
| 440379 | 12/1935 | (GB) . |
| 679292 | 9/1952 | (GB) . |
| 1 476 889 | 6/1977 | (GB) . |
| 2 009 602 A | 6/1979 | (GB) . |
| 2 126 906 | 9/1983 | (GB) . |
| 08112379 | 5/1996 | (JP) . |
| 10015128 | 1/1998 | (JP) . |
| 10-94623 | 4/1998 | (JP) . |
| 10099474 | 4/1998 | (JP) . |
| 10-201887 | 8/1998 | (JP) . |
| 10-225538 | 8/1998 | (JP) . |
| 10-248964 | 9/1998 | (JP) . |

OTHER PUBLICATIONS

*Wilson* Golf History—Catalogs, Vintage Golf, 1981,pp. 2, 3, 5.

Pinseeker Golf Corporation Advertisement in Golf Digest, Sep. 1982, p. 25.

The Golf Club Identification and Price guide, Jan. 1985, PGA 1983–1984 Emblem Irons, pp. 27–26.

Pinseeker Golf Corporation Advertisement in Golf Magazine, Jun. 1983, p. 115.

The Golf Club Identification and Price Guide III, Jan. 1985, PGA 1983–1986 Emblem Irons,pp. 43–38.

Pinseeker Golf Corporation Advertisement in Golf Digest Magazine, Sep. 1988, p. 110.

*Primary Examiner*—Sebastiano Passaniti
(74) *Attorney, Agent, or Firm*—Pennie & Edmonds LLP

(57) ABSTRACT

A golf club head includes a plurality of exterior walls which define a hollow interior cavity. The golf club head further includes an interior wall structure extending from one of the walls into the interior cavity. The interior wall structure defines a chamber therein. The chamber contains a flowable weighted material and a lighter weight flowable filler material. Both the weighted and the filler materials can be inserted and removed from the chamber through an aperture in the wall.

28 Claims, 8 Drawing Sheets

U.S. PATENT DOCUMENTS

| | | |
|---|---|---|
| 1,446,577 | 2/1923 | Nix . |
| 1,453,503 | 5/1923 | Holmes . |
| 1,454,267 | 5/1923 | Challis et al. . |
| 1,467,435 | 9/1923 | Kinnear . |
| 1,497,578 | 6/1924 | Mothersele . |
| 1,509,429 | 9/1924 | Hillerich . |
| 1,518,316 | 12/1924 | Ellingham . |
| 1,524,488 | 1/1925 | Read . |
| 1,526,438 | 2/1925 | Scott . |
| 1,529,009 | 3/1925 | Carpenter . |
| 1,538,312 | 5/1925 | Beat . |
| 1,546,612 | 7/1925 | Barnes . |
| 1,574,213 | 2/1926 | Tyler . |
| 1,582,836 | 4/1926 | Link . |
| 1,592,463 | 7/1926 | Marker . |
| 1,598,050 | 8/1926 | Butchart . |
| 1,607,284 | 11/1926 | Kraeuter . |
| 1,617,090 | 2/1927 | Worthington . |
| 1,621,750 | 3/1927 | Questel et al. . |
| 1,666,174 | 4/1928 | Holland . |
| 1,678,637 | 7/1928 | Drevitson . |
| 1,707,677 | 4/1929 | Mackay . |
| 1,840,924 | 1/1932 | Tucker . |
| 1,868,286 | 7/1932 | Grieve . |
| 1,913,821 | 6/1933 | Stumpf . |
| 1,917,774 | 7/1933 | Ogg et al. . |
| 2,002,108 | 5/1935 | Child . |
| 2,067,556 | 1/1937 | Wettlaufer . |
| 2,163,091 | 6/1939 | Held . |
| 2,198,981 | 4/1940 | Sullivan . |
| 2,214,356 | 9/1940 | Wettlaufer . |
| 2,257,575 | 9/1941 | Reach . |
| 2,301,369 | 11/1942 | Carvill . |
| 2,328,583 | 9/1943 | Reach . |
| 2,332,342 | 10/1943 | Reach . |
| 2,360,364 | 10/1944 | Reach . |
| 2,457,084 | 12/1948 | Kearsley et al. . |
| 2,460,435 | 2/1949 | Schaffer . |
| 2,486,952 | 11/1949 | Kearsley et al. . |
| 2,517,245 | 8/1950 | Scott . |
| 2,538,312 | 1/1951 | Heyworth et al. . |
| 2,592,013 | 4/1952 | Curley . |
| 2,756,055 | 7/1956 | Bittner . |
| 2,960,338 | 11/1960 | Havey et al. . |
| 3,064,980 | 11/1962 | Steiner . |
| 3,075,768 | 1/1963 | Karns . |
| 3,143,349 | 8/1964 | MacIntyre . |
| 3,191,936 | 6/1965 | Guier . |
| 3,212,783 | 10/1965 | Bradley et al. . |
| 3,356,782 | 12/1967 | Whyte . |
| 3,466,047 | 9/1969 | Rodia et al. . |
| 3,582,081 | 6/1971 | Caplan . |
| 3,606,327 | 9/1971 | Gorman . |
| 3,610,630 | 10/1971 | Glover . |
| 3,625,518 | 12/1971 | Solheim . |
| 3,652,094 | 3/1972 | Glover . |
| 3,692,306 | 9/1972 | Glover . |
| 3,761,095 | 9/1973 | Thompson . |
| 3,834,700 | 9/1974 | Averbach . |
| 3,845,960 | 11/1974 | Thompson . |
| 3,847,399 | 11/1974 | Raymont . |
| 3,897,066 | 7/1975 | Belmont . |
| 3,941,390 | 3/1976 | Hussey . |
| 3,961,796 | 6/1976 | Thompson . |
| 3,966,210 | 6/1976 | Rozmus . |
| 3,972,528 | 8/1976 | McCracken et al. . |
| 3,976,299 | 8/1976 | Lawrence et al. . |
| 3,979,122 | 9/1976 | Belmont . |
| 4,021,047 | 5/1977 | Mader . |
| 4,027,885 | 6/1977 | Rogers . |
| 4,043,563 | 8/1977 | Churchward . |
| 4,052,075 | 10/1977 | Daly . |
| 4,076,254 | 2/1978 | Nygren . |
| 4,085,934 | 4/1978 | Churchward . |
| 4,139,196 | 2/1979 | Riley . |
| 4,145,052 | 3/1979 | Janssen et al. . |
| 4,162,794 | 7/1979 | Thompson . |
| 4,180,269 | 12/1979 | Thompson . |
| 4,206,924 | 6/1980 | Koralik . |
| 4,214,754 | 7/1980 | Zebelean . |
| 4,313,607 | 2/1982 | Thompson . |
| 4,319,752 | 3/1982 | Thompson . |
| 4,326,716 | 4/1982 | LaCoste . |
| 4,355,808 | 10/1982 | Jernigan et al. . |
| 4,438,931 | 3/1984 | Motomiya . |
| 4,449,707 | 5/1984 | Hayashi et al. . |
| 4,451,042 | 5/1984 | Hayashi et al. . |
| 4,471,961 | 9/1984 | Masghati et al. . |
| 4,502,687 | 3/1985 | Kochevar . |
| 4,553,755 | 11/1985 | Yamada . |
| 4,607,846 | 8/1986 | Perkins . |
| 4,655,459 | 4/1987 | Antonius . |
| 4,695,054 | 9/1987 | Tunstall . |
| 4,714,577 | 12/1987 | Nagamoto et al. . |
| 4,730,830 | 3/1988 | Tilley . |
| 4,795,159 | 1/1989 | Nagamoto . |
| 4,803,023 | 2/1989 | Enomoto et al. . |
| 4,811,949 | 3/1989 | Kobayashi . |
| 4,824,116 | 4/1989 | Nagamoto et al. . |
| 4,867,458 | 9/1989 | Sumikawa et al. . |
| 4,869,507 | 9/1989 | Sahm . |
| 4,927,144 | 5/1990 | Stormon . |
| 5,013,041 | 5/1991 | Sun et al. . |
| 5,050,879 | 9/1991 | Sun et al. . |
| 5,056,705 | 10/1991 | Wakita et al. . |
| 5,058,895 | 10/1991 | Igarashi . |
| 5,078,400 | 1/1992 | Desbiolles et al. . |
| 5,120,062 | 6/1992 | Scheie et al. . |
| 5,141,230 | 8/1992 | Antonious . |
| 5,143,571 | 9/1992 | Lacoste et al. . |
| 5,154,424 | 10/1992 | Lo . |
| 5,178,392 | 1/1993 | Santioni . |
| 5,193,806 | 3/1993 | Burkly . |
| 5,193,811 | 3/1993 | Okumoto et al. . |
| 5,207,428 | 5/1993 | Aizawa . |
| 5,219,408 | 6/1993 | Sun . |
| 5,251,901 | 10/1993 | Solheim et al. . |
| 5,273,283 | 12/1993 | Bowland . |
| 5,310,186 | 5/1994 | Karsten . |
| 5,312,106 | 5/1994 | Cook . |
| 5,385,348 | 1/1995 | Wargo . |
| 5,421,577 | 6/1995 | Kobayashi . |
| 5,431,401 | 7/1995 | Smith . |
| 5,447,309 | 9/1995 | Vincent . |
| 5,482,281 | 1/1996 | Anderson . |
| 5,590,881 | 1/1997 | Jernigan . |
| 5,613,916 | 3/1997 | Sommer . |
| 5,629,475 | 5/1997 | Chastonay . |
| 5,655,976 | 8/1997 | Rife . |
| 5,658,207 | 8/1997 | Aizawa et al. . |
| 5,676,606 | 10/1997 | Schaeffer et al. . |
| 5,755,624 | 5/1998 | Helmstetter . |
| 5,766,091 | 6/1998 | Humphrey et al. . |
| 5,776,011 | 7/1998 | Su et al. . |
| 5,797,807 | 8/1998 | Moore . |
| 5,807,188 | 9/1998 | Serrano et al. . |
| 6,089,994 | 7/2000 | Sun . |

FIG. 8
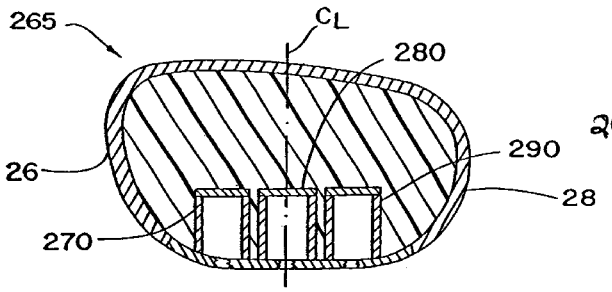
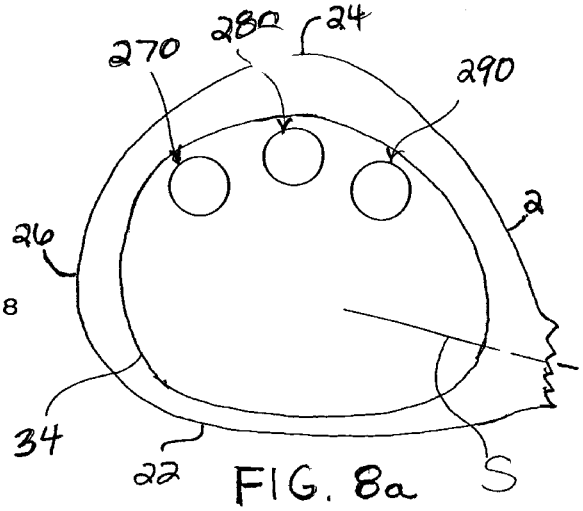
FIG. 8a
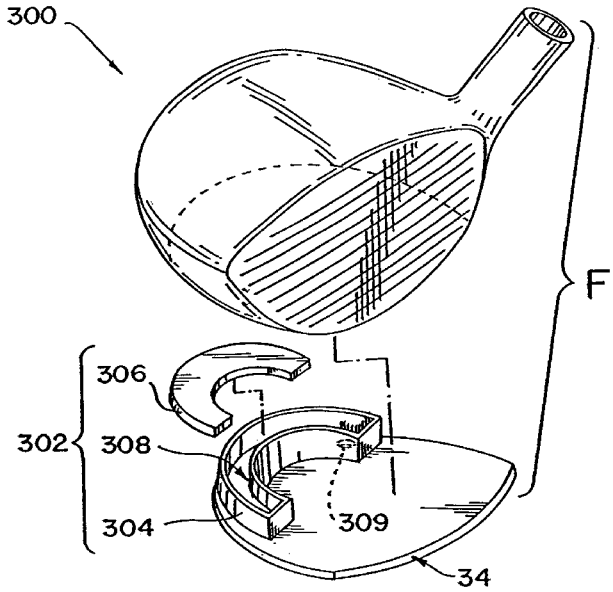
FIG. 9

GOLF CLUB HEAD WITH WEIGHT ADJUSTMENT

TECHNICAL FIELD

The present invention relates to golf clubs and, more particularly, to a golf club head that has components for adjusting the weight of the club head.

BACKGROUND OF THE INVENTION

Golf clubs are generally selected based on a number of criteria. One of these is the swing weight of the club which takes into consideration the weight of all of the club's components including the head, the shaft and the grip during use. Many golfers would prefer to have the swing weight of their clubs match to their individual needs. This is accomplished by custom-making clubs for the golfer. Since custom clubs are expensive, many golfers do not have the swing weight of their clubs matched to them individually.

Since club makers must limit the number of clubs that they design and manufacture, they limit the number of different swing weights they can offer golfers. It is desirable both to the golfer and the manufacturer to make a club that can have the swing weight adjusted after the club is formed. Various developments have attempted to provide adjustable weighted club heads.

It is desired that a club head is devised which has a simple design but allows customization of the weight of the club head in small increments. However, it is also desirable that this club head is acceptable under the rules of the USGA.

SUMMARY OF THE INVENTION

An object of the present invention is to provide a golf club head with adjustable weight.

Another object of the present invention is to provide a golf club head with weight which is adjustable in small increments.

Yet another object of the present invention is to provide a golf club head where the location of the center of gravity can be adjusted within the club head.

According to the present invention, a golf club is formed to define a hollow interior cavity and includes a first, support wall. The club further includes a chamber connected to the support and extending into the interior cavity of the head. The chamber receives a first flowable material and a second flowable material. The first material weights more than the second material. Since both materials are flowable they can be added and removed from the chamber through an aperture. Depending on the arrangement of the materials, the weight and location of the center of gravity of the club head can be varied.

According to the present invention the second material has a fluid state and a set state.

In one embodiment, the chamber extends from a sole plate of the club head, and the material is arranged in layers.

BRIEF DESCRIPTION OF THE DRAWINGS

FIG. 8 is a cross-sectional view of the golf club head similar to FIG. 4 showing another embodiment of the present invention where the club head contains a plurality of weight chambers prior to insertion of the weighted and filler materials.

FIG. 8*a* is a top view of the golf club head shown in FIG. 8 showing the arrangement of the weight chambers.

FIG. 9 is an exploded, perspective view of another embodiment of a golf club head similar to that shown of FIG. 2, showing a sole plate with an arcuate weight chamber.

DETAILED DESCRIPTION OF THE INVENTION

Figure 1:
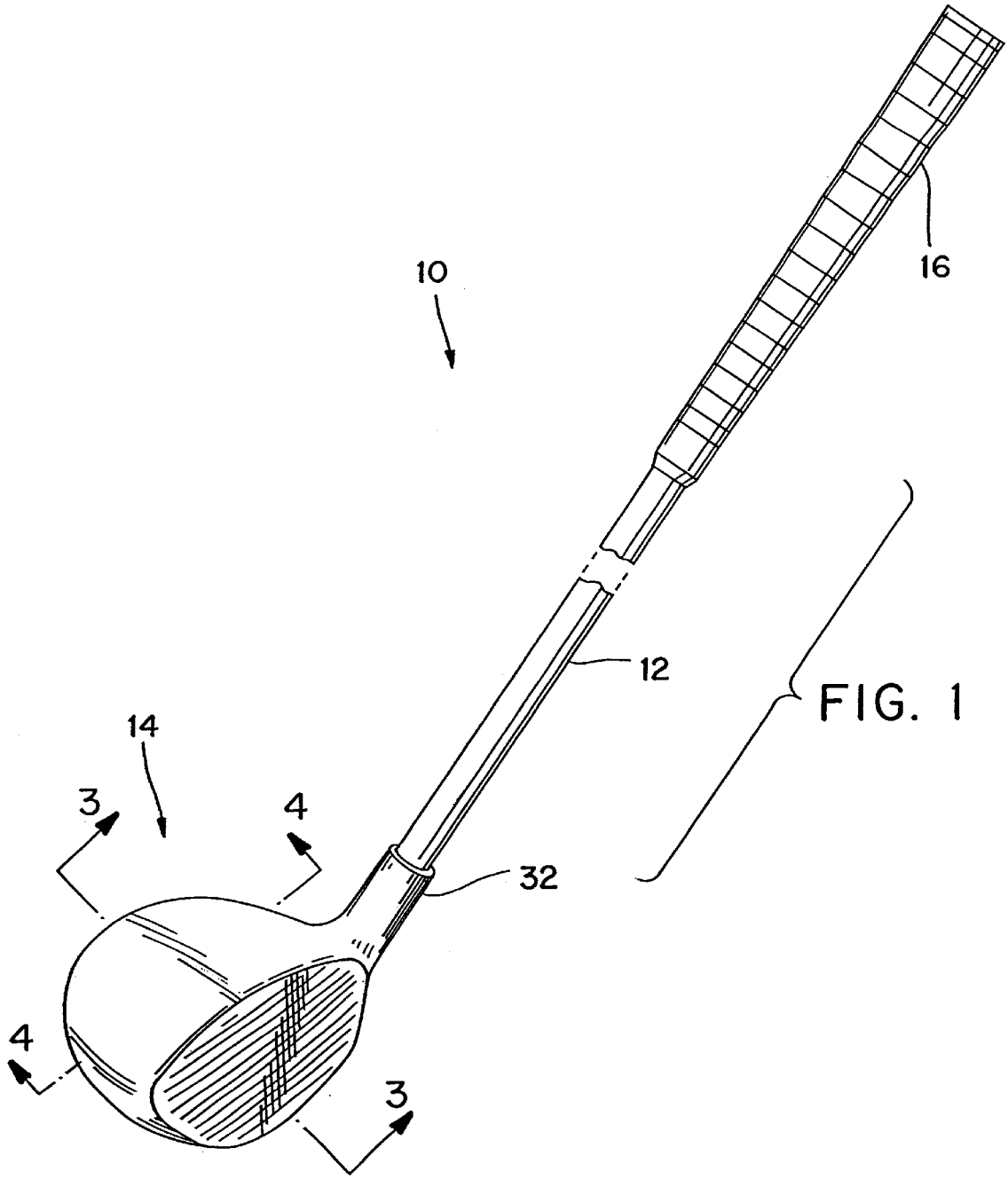
FIG. 1 is a front, perspective view of a golf club of the present invention.
Figure 2:
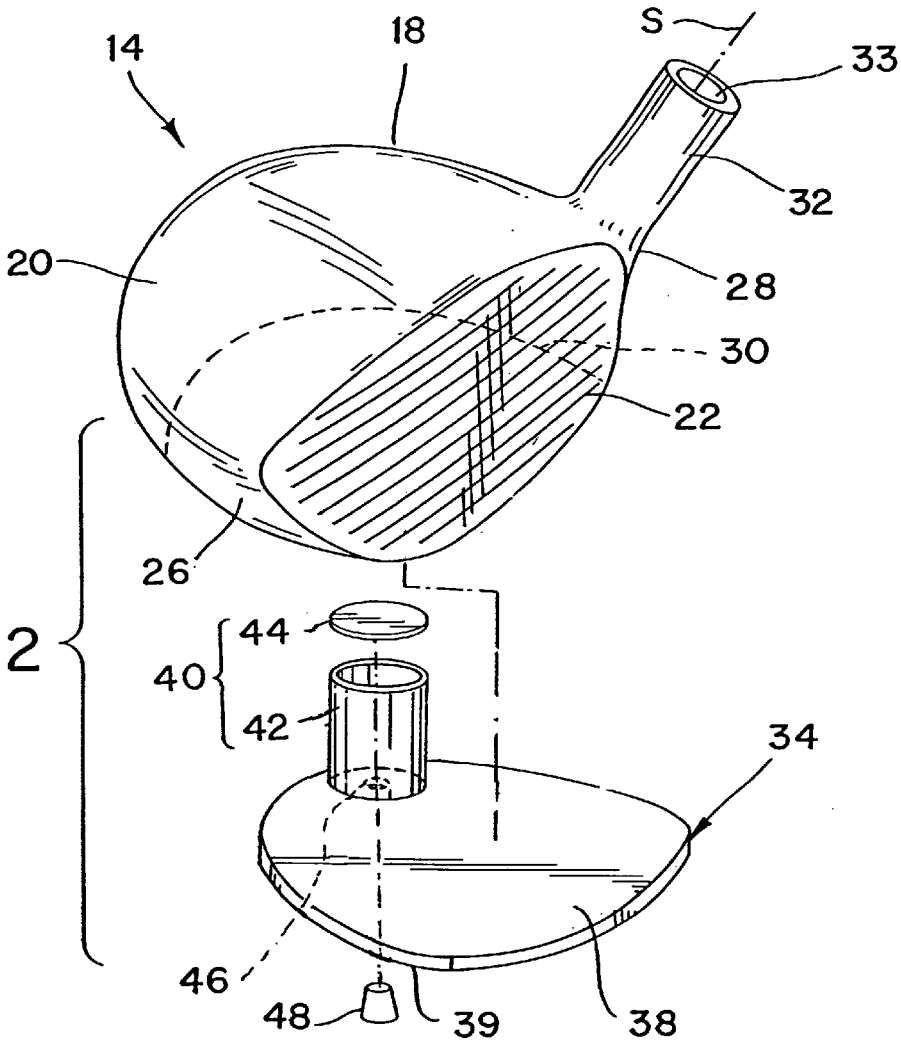
FIG. 2 is an exploded, perspective view of the golf club head shown in FIG. 1.
Figure 3:
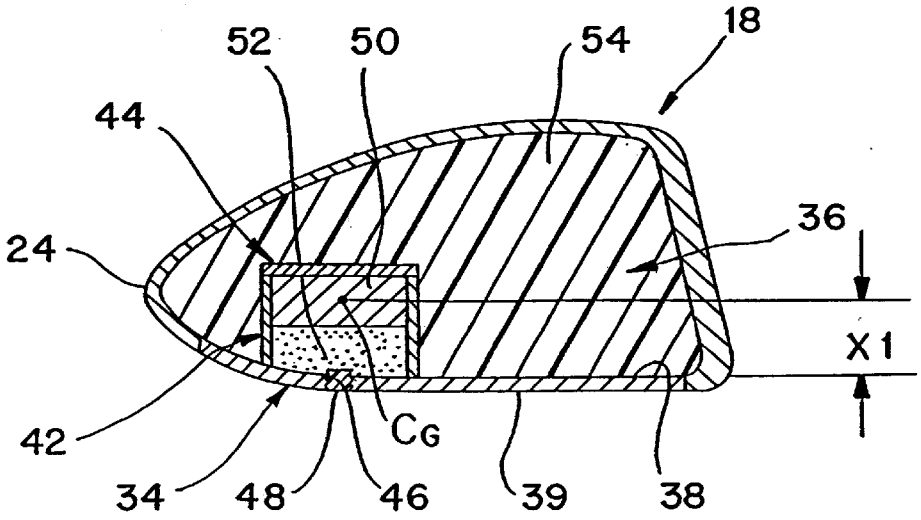
FIG. 3 is a cross-sectional view of the golf club head along line 3—3 of FIG. 1 showing a weight chamber of the present invention filled with weighted and filler materials.
Figure 4:
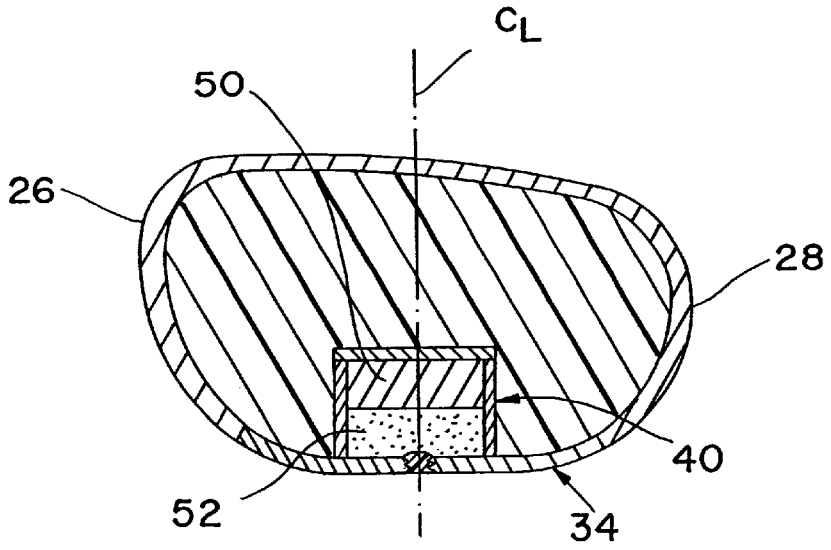
FIG. 4 is a cross-sectional view of the golf club head along line 4—4 of FIG. 1.

Referring to FIGS. 1–3, a wood-type golf club 10 has a shaft 12 (only partially shown) with a club head 14 attached to one end of the shaft and a grip 16 attached to the other end. The club head 14 has a body 18 including an upper wall 20, a front wall 22, a rear wall 24, a toe wall 26, and a heel wall 28. The body 18 defines a bottom opening 30 (shown in phantom in FIG. 2). A hosel 32 extends from the heel wall 28. The hosel 32 defines a bore 33 extending there through. The bore 33 accepts the shaft 12. The center of the hosel 32 defines a shaft axis S. Centerline $C_L$ is disposed generally midway between the toe the heel of the club head.

Referring to FIGS. 2 and 3, the club head 14 further includes a lower or support wall or sole plate 34, which is configured to cover the opening 30 in the bottom of the body 18. Thus, the golf club head defines an interior cavity 36 therein. In this embodiment the golf club head is formed of two separate pieces the body 18 and sole plate 34. However, in other embodiments the club head can be formed of a single or multiple parts as is known in the art. The bore 33 through the hosel 32 is a conduit into the interior cavity 36.

In one embodiment, the hosel forms a shaft through the body of the club head to a lower corner wall. The lower comer wall includes an aperture. In this embodiment the shaft extends through the entire club head to the aperture in the comer wall. Several holes in the shaft can form a conduit into the interior cavity from the hosel bore.

The sole plate 34 includes an interior surface 38 and a spaced, exterior surface 39. The sole plate 34 further includes a chamber 40 coupled to and extending from the interior surface 38 thereof. The chamber 40 is a wall structure that includes a side wall member 42 and a top wall or cap 44. The side wall member 42 has a cylindrical shape, and the cap 44 is welded to the top of the side wall member 42 to close the upper end of the chamber 40. The chamber 40 defines a chamber volume therein. In another embodiment, the sole plate 34 and chamber 40 are formed separately and connected using conventional techniques, such as welding or the cap is formed integrally with the side wall member.

The cap can also have an aperture there through, and the support wall has a nut attached thereto, such as by welding and the chamber surrounding the nut. The free end of a bolt is disposed through the aperture in the cap and engages the nut. After tightening the bolt the blot head connects the cap to the chamber. The arrangement of the nut and bolt can be changed so that the bolt is secured to the support wall and the free end extends out of the cap. Then the nut is connected to the bolt on the exterior of the cap.

Referring to FIGS. 1–4, the chamber 40 is disposed on the sole plate 34 so that it is generally centered with respect to the centerline $C_L$ of the club head and is disposed rearwardly of the shaft axis S. As a result, the chamber 40 is generally centered between the heel and the toe walls, in the transverse direction within the club head. The chamber 40 is also adjacent the rearmost edge of the sole plate or the rear wall 24 of the club head.

Referring to FIGS. 2 and 3, the sole plate 34 also defines an internally threaded aperture 46 extending from the interior surface 38 to the exterior surface 39. The aperture 46 is disposed aligned with the chamber 40 so that it is a conduit into the chamber from the exterior of the club head. A plug 48 is disposed within the aperture 46 to close the aperture.

Referring to FIG. 3, the chamber 40 has a first or weighted material 50 and a second or filler material 52 disposed therein. The weighted material is disposed in one section of the chamber and the filler material is disposed in another, discrete section of the chamber. In this embodiment, the sections allow the materials to form layers. However, in another embodiment, the sections can have other geometries for example the first material can form a sphere centered within the second material.

Referring again to FIG. 3, the filler material 52 is disposed between the weighted material 50 in its section and the sole plate 34. The weighted material volume combined with the filler material volume substantially equals the chamber volume. The weighted material 50 should have a predetermined weight, density or specific weight, which allows the weighted material to change the weight distribution in the club head. The filler material should have a weight that is substantially less than the weight of the weighted material. Since the filler material weighs substantially less than the weighted material the club head is configured so that the weighted material is suspended or spaced from the sole plate within the club head.

The weighted material 50 is flowable so that it can be poured into the chamber through the aperture. It is preferred that the weighted material is formed of particles. Each particle of the weighted material should have a diameter less than the diameter of the aperture 46 so that it is pourable into the chamber 40 through the aperture 46. One recommended diameter for each particle of weighted material is about 0.016 inches. Recommended weighted materials are tungsten, copper, aluminum, and mixtures thereof. However, the present invention is not limited to these weighted materials, for example a weighted material like molten metal can be liquified and poured into the chamber where it can harden. The preferred weighted material is tungsten powder, for example the commercially available tungsten powder manufactured by Kennametal.

The filler material 52 has a fluid state so that it is injectable into the chamber 40 through the aperture 46. The filler material 52 also has a set state where the material has changed into a solid or gel. Once the filler material sets, it secures the weighted material within the chamber in its respective section. Recommended filler materials are adhesive, glue, such as hot melt, caulking material or thermosetting resins, thermoplastic resins, epoxy, or mixtures thereof. However, the present invention is not limited to these filler materials.

Referring to FIGS. 2 and 3 in the preferred embodiment, the plug 48 is formed of plastic and has a truncated conical shape. The plug 48 is sized so that when it is inserted into the threaded aperture 46, the threads of the aperture dig into the surface of the plug and secure the plug within the sole plate 34. An adhesive, glue or epoxy is applied to the plug 48 prior to insertion in the sole plate to further secure it therein. The use of the adhesive, glue or epoxy with the plug is optional.

The dimensions of the side wall member 42, such as the internal diameter and height can vary depending on the weight requirements desired. Similarly, the thickness and diameter of the cap 44 can vary. The dimensions of these components dictate the chamber volume, and thus the maximum amount of weighted and filler materials that is disposed therein. One of ordinary skill in the art can determine the dimensions of the side wall member and cap depending on the desired chamber volume.

Referring to FIG. 3, the weighted and filler materials 50 and 52, for example have a combined mass of between about 10 grams and about 12 grams. The mass of the weighted material 50, in one preferred embodiment, is about eight grams and the mass of the filler material 52 are about two grams, so that the weighted material mass is four times the filler material mass. As a result, the center of gravity Cg of the chamber is spaced a distance X1 from the interior surface 38 of the sole plate 34.

Manufacture of the club head will now be discussed with reference to FIGS. 1–3. The body 14 and sole plate 34 are cast from conventional materials. The side wall member 42 is cast integrally with the sole plate 34. The aperture 46 is also cast into the sole plate. The internal threads are formed by conventional methods. The cap 44 is attached to the side wall member 42 using welding. Once these components are formed, the sole plate 34 is attached to the body 14 such as by welding.

A water-based foam 54 is injected into the interior cavity 36 of the club head through the hosel bore 33. In another embodiment, conventional means such as a bore through one of the body walls is used to fill the interior cavity with foam. Then, the club head body 14 is attached to one end of the shaft 12, and the grip 16 is attached to the other end of the shaft.

A predetermined starting amount of weighted material 50 is poured into the chamber 40 using the aperture 46. A removable closure material, such as tape, is used to temporarily seal the aperture. A player can then swing the club head and determine if the swing weight of the club meets their needs. The weighted material is added or remove using the aperture 46, until substantially the proper weight is achieved.

If the club head is tested for weight by the player with only the weighted material 50 within the chamber, the center of gravity for the club head is lower than it will be with the filler material in the chamber. The player can adjust the swing weight first without the filler material. The club maker removes enough weighted material and adds the filler material so that the weight of both materials equals the weight that the player desired. If the club head does not feel or perform as the player desires, the player can adjust the center of gravity. The filler material must be removed before it is set and the configuration or the ratios of weighted material to filler material must be adjusted to get the desired center of gravity location as discussed below. The aperture 46 is closed with the plug 48.

If this method of adjustment is not used, a temporary light weight filler material, such as sand. It is desirable that the temporary filler material can be injected through the aperture, does not set, and has a weight similar to the setting filler material. Then, the swing weight can be adjusted by adding and removing the amount of the weighted and temporary filler material. Once the weight is set, the configuration and ratio of the weighted and filler material can be adjusted until the desired center of gravity is achieved. Upon determining and recording the desired configuration, the chamber can be emptied and filled according to the desired configuration using the setting filler material 52. The aperture 46 is closed with the plug 48.

Thus, the present invention allows club makers to design and manufacture fewer club heads, but allows the makers to have the flexibility to customize clubs heads with a particular weight and center of gravity location for an individual golfer or a group of golfers, such as women, tour-professionals, or seniors.

Figure 5:
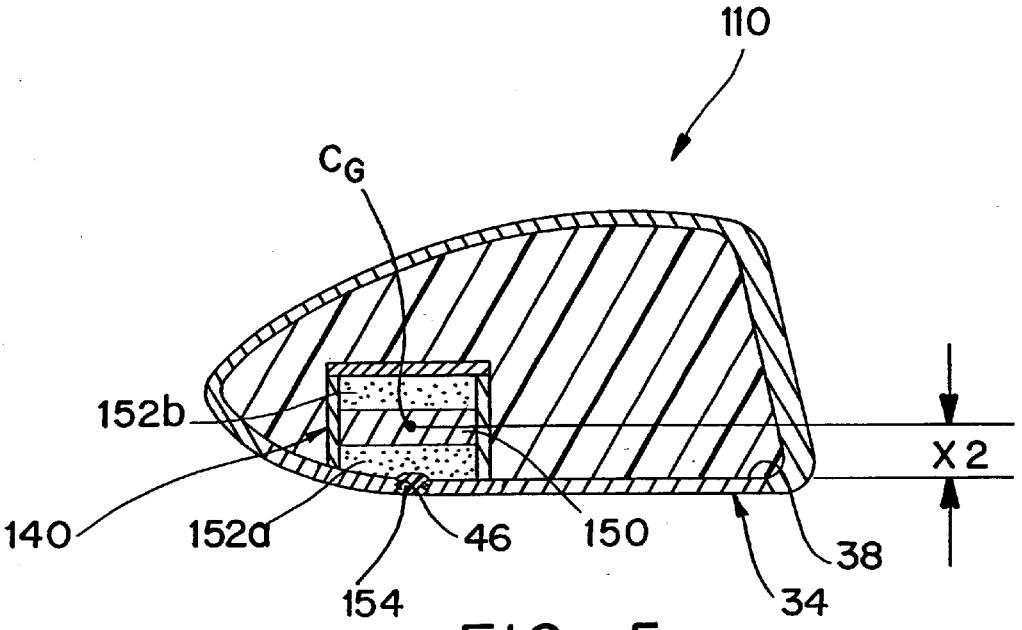
FIG. 5 is a cross-sectional view of the golf club head similar to FIG. 3 showing another embodiment of the present invention where the weighted and filler materials form three layers.

Referring to FIG. 5, the golf club head 110 has been modified so that the chamber 140 has two layers of the filler material 152*a* and 152*b* and one layer of the weighted material 150 between the layers of the filler material 152*a* and 152*b*. As a result, the layer of the weighted material 150 is spaced from the ends of the chamber, so that the center of gravity Cg of the chamber 140 is spaced a distance X2 above the sole plate interior surface 38. The distance X2 is less than the distance X1 (as shown in FIG. 3), thus the $_{Cg}$ of chamber 140 is lower than the $_{Cg}$ of chamber 40. Thus, varying the configuration of the filler and weighted layers within the chamber 140, varies the location of the center of gravity of the chamber and the club head vertically.

The closure element is a fastener 154 is in aperture 46 instead of the plug. The fastener 154 is, for example, a metal or plastic screw that is externally threaded to mate with the internal threads of the aperture 46. The fastener 154 is formed so that after insertion it is flush with the exterior surface of the sole plate. Alternatively, the fastener is formed so that it extends from the exterior surface. Then conventional techniques, such as brazing, are used so that the fastener is flush with the sole plate exterior surface. In another embodiment, the fastener can be extending into the chamber a substantial amount so that it further secures the weighted and filler material within the chamber.

Figure 6:
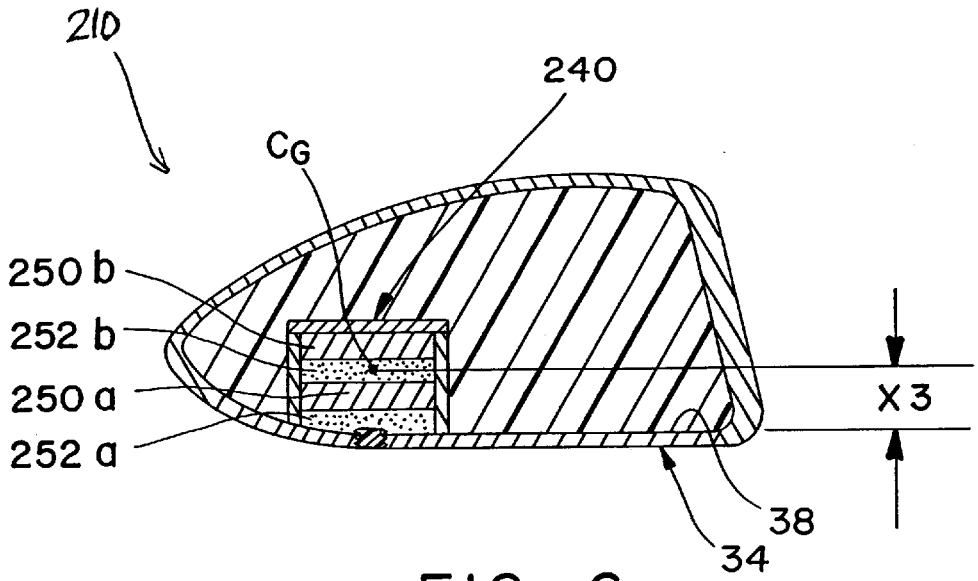
FIG. 6 is a cross-sectional view of the golf club head similar to FIG. 3 showing yet another embodiment of the present invention where the weighted and filler materials form four layers.

Referring to FIG. 6, the golf club head 210 has been modified so that the chamber 240 has two layers of the filler material 252*a,b* and two layers of the weighted material 250*a,b*. The first layer of the filler material 252*a* is adjacent to the sole plate 34, then the first layer of the weighted material 250*a* is disposed thereon. Next, the second layer of filler material 252*b* is disposed on the layer 250*a*, and the second layer of the weighted material 250*b* is disposed upon layer 252*b*. The filler layers and weighted layers alternate, and the center of gravity $_{Cg}$ of the chamber 240 is spaced a distance X3 above the sole plate interior surface 38. The distance X3 is less than the distance X1 (as shown in FIG. 3), thus the $_{Cg}$ of chamber 240 is lower than the $_{Cg}$ of chamber 40. Thus, by varying the configuration of the layers, the center of gravity of the chamber can be varied vertically which thus varies the center of gravity of the club head.

Figure 7:
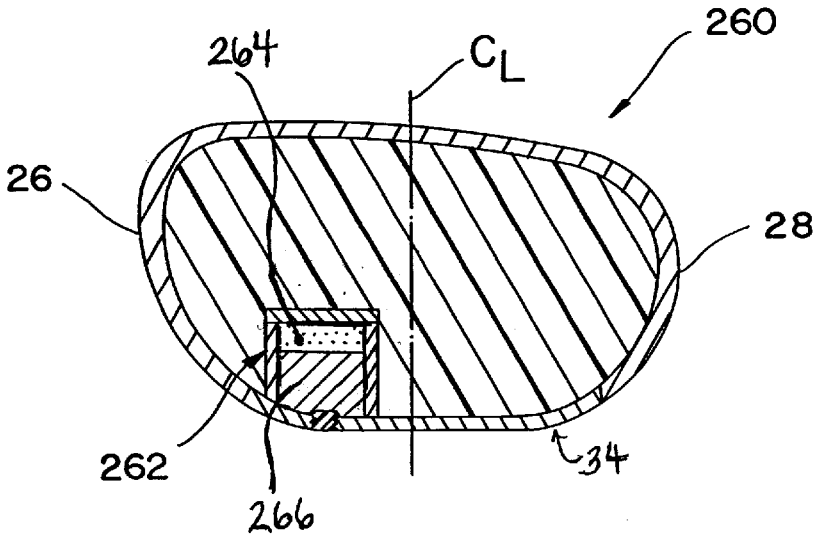
FIG. 7 is a cross-sectional view of the golf club head similar to FIG. 4 showing yet another embodiment of the present invention where the weight chamber is near the toe wall.

Referring to FIG. 7, the golf club head 260 is similar to the golf club head 10 shown in FIGS. 1–4, however the golf club head 260 has been modified so that the chamber 262 is disposed between the toe wall 26 and the centerline $C_L$. The chamber 262 has also been modified so that the layer of weighted material 264 is adjacent the sole plate 34 and the layer of filler material 266 is disposed thereon. Thus, the club head 260 is toe-weighted and the center of gravity $_{Cg}$ is lower than shown in FIG. 3. The golf club head can also be modified so that the weight chamber is disposed between the centerline $C_L$ and the heel wall 28. Thus, the club head would be heel-weighted.

Referring to FIG. 8, the golf club head 265 shown is similar to the golf club head shown in FIGS. 1–4, however the golf club head 265 has been modified so that the club head includes three chambers 270, 280, and 290. The first chamber 270 is disposed between the centerline $C_L$ and the toe wall 26. The second chamber 280 is generally centered with the centerline $C_L$. The third chamber 290 is disposed between the centerline $C_L$ and the heel wall 28. Referring to FIG. 8*a*, the chambers 270, 280 and 290 follow the arc of the back of the sole plate 34 and are all disposed rearward of the shaft axis S. This allows the weight to be low and as far back as possible so that the inertial properties are improved.

During manufacture, at least one of the chambers is filled with the weighted material and the filler material through the associated aperture. The chambers are closed with the plugs or fasteners as discussed above. The club head is used to form a toe-weighted, heel-weighted or center-weighted club head. This club head can also be used with two or three chambers filled with the same or varying amounts of the weighted and filler materials. Furthermore, each filled chamber can have a different layered arrangement of the weighted material and the filler material. Thus, the head 265 offers numerous options for customization.

Referring to FIG. 9, the golf club head 300 is similar to the golf club head shown in FIG. 2. However, the chamber 302 has an arcuate shape that matches the shape of the rear of the sole plate 34 or the rear wall 24 (as shown in FIG. 3). The chamber 302 includes a wall structure 304 extending from the interior surface of the sole plate 34 and a cap 306. Once the cap 306 is secured on the wall structure 304, there is a chamber volume 308 defined therein. The chamber volume 308 receives the weighted material and the filler material as discussed above. The sole plate 34 further includes an aperture 309 (shown in phantom) there through. The aperture 309 is a conduit into the chamber 308. The aperture 309 is closed with a plug or fastener as discussed above.

The shape of the chamber 308 allows the weighted material to be distributed along the back of the sole plate 34. Other chamber shapes, such as rectangular, triangular, semi-circular, and hemispherical can be used to allow the club maker to place the weighted material in any desired location on the sole plate. However, the present invention is not limited to these shapes. In another embodiment, the support wall for a chamber of any shape can define a plurality of spaced apertures there through for filling the chamber.

Figure 10:
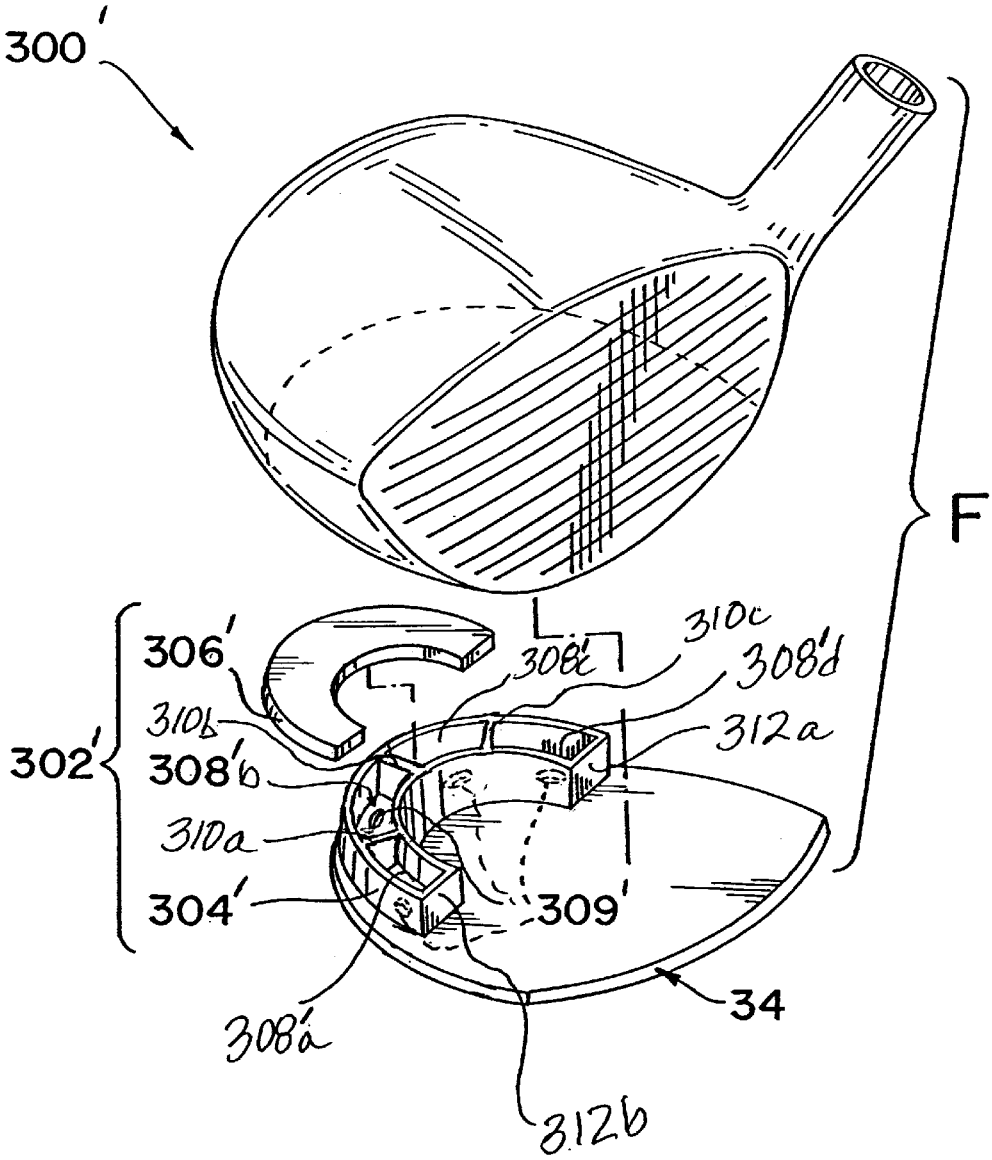
FIG. 10 is an enlarged, exploded, perspective view of another embodiment of a golf club head similar to that shown of FIG. 2, showing a sole plate with an arcuate weight chamber divided into separate chambers.

Referring to FIG. 10, the golf club head 300' is similar to the golf club head 300' shown in FIG. 9, and similar elements have the same number followed by a prime symbol. The chamber 302' has an arcuate shape that matches the shape of the rear of the sole plate 34 or the rear wall 24 (as shown in FIG. 3). The chamber 302' includes a wall structure 304' extending from the interior surface of the sole plate 34 and a cap 306. The wall structure 304' has two end walls 312*a* and 312*b*, two middle walls 314*a* and 314*b*, and a plurality of internal walls 310*a–c*. The wall structure 304' defines a plurality of separate weight chambers 308'*a*–308'*d*. Each chamber is curved and extends across a sector of the arcuate shape from one end to the other. Once the cap 306 is secured on the wall structure 304, there are separate chamber volumes 308*a'*–308'*d* defined therein. The separate chambers receive the weighted material and the filler material as discussed above. The sole plate 34 further includes an aperture 309' (shown in phantom) in each separate chamber there through. The apertures 309' are a conduits into the separate chambers 308'*a*–308'*b*. The apertures 309' are closed with a plug or fastener as discussed above. The shape of the chamber allows the weighted material to be distributed along the back of the sole plate 34, and the separate chamber allows the weight to be distributed in one or more chamber to heel-weight, toe-weight, or center-weight the club head. Other chamber shapes, such as rectangular, triangular, semi-circular, and hemispherical can be used to allow the club maker to place the weighted material in any desired location on the sole plate. However, the present invention is not limited to these shapes.

Figure 11:
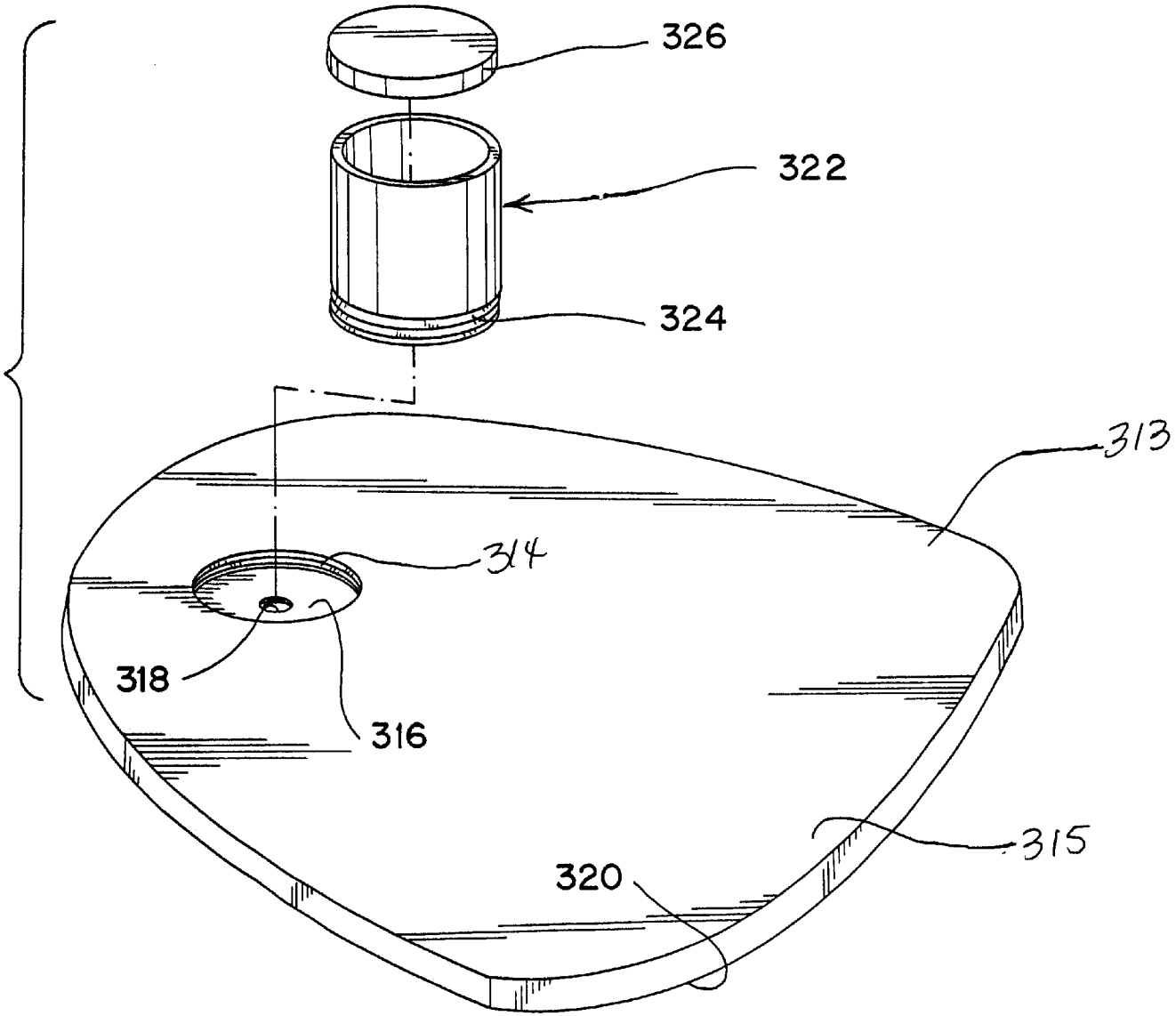
FIG. 11 is an enlarged, perspective view of another embodiment of the sole plate and weight chamber of the present invention.

Referring to FIG. 11, the sole plate 313 is similar to that shown in FIG. 2. However, the sole plate 313 includes an internally threaded bore 314 that extends from the interior surface 315 to a lower surface 316. The sole plate 313 further includes an internally threaded aperture 318 for receiving a plug as discussed above. The aperture 318 extends between the lower surface 316 and the exterior surface 320 of the sole plate 310. The cylindrical side wall member 322 includes an externally, threaded lower portion 324 for connecting the side wall member 322 to the sole plate via the internally threaded bore 312. A cap 326 is coupled to the top end of the member 322 using conventional techniques. The side wall member and cap form an internal chamber that receives the weighted and filler material through the aperture 318 as discussed above. In this embodiment, the side wall member 322 and cap 326 can be formed of metal or plastic. If the side wall member is formed of metal, tact welding can be used to further secure the side wall member to the sole plate. If the side wall member is formed of plastic, an adhesive such as epoxy can be used to further secure the side wall member to the sole plate.

Figure 12:
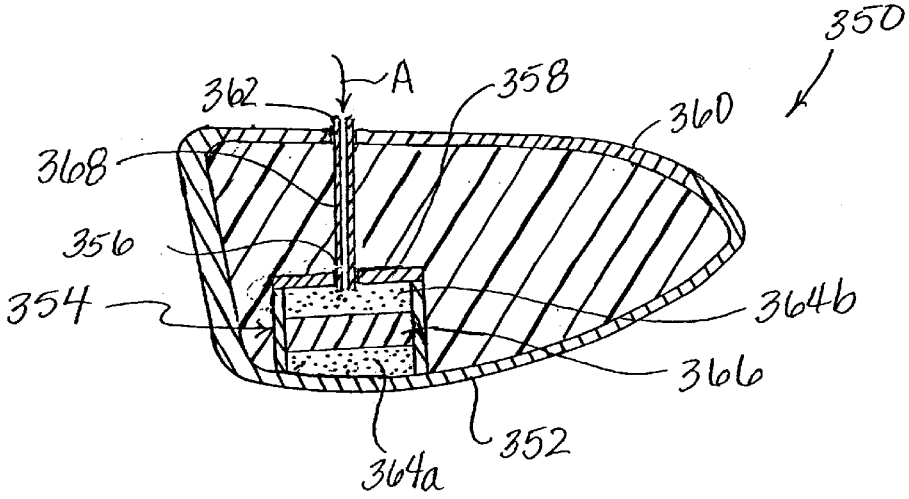
FIG. 12 is a cross-sectional view of the golf club head similar to FIG. 3 showing another embodiment of the present invention where the weight chamber is connected to an upper wall during insertion of the weighted and filler materials.

Referring to FIG. 12, the golf club head 350 has been modified and is illustrated in an inverted position while the filler material and weighted material are being inserted within the chamber. The golf club head 350 includes an upper wall 352, which has a chamber 354 connected thereto. This embodiment illustrates that the chamber or a plurality of chambers can extend from the upper, front, rear, tow or heel walls in the present invention. When the chamber extends from the upper, front, rear, toe or heel walls, the center of gravity of the club head can be varied between the heel and toe walls, the front and rear walls, and the lower and upper walls depending on the configuration of the weighted and filler material layers.

This embodiment also illustrates an another method for filling the club head. The chamber 354 is formed with an aperture 356 through the cap 358. The sole plate 360 has an aperture 362 defined there through substantially aligned with the aperture 356 in the cap. A tube can be inserted through the sole aperture 360 and the cap aperture 356 so that the filler material 364*a,b* and the weighted material 366 can be inserted into the chamber 354. A tube 368 can be disposed through the apertures for transporting the materials into the chamber according to the arrow A. The aperture 356 is closed with the filler material once it sets. Then a closure element, as discussed above, can be used to seal the sole aperture.

Figure 13:
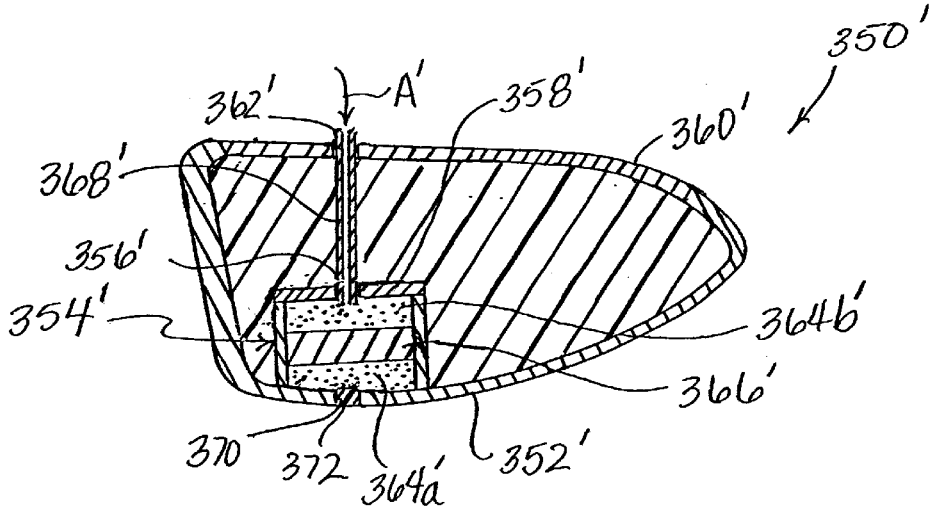
FIG. 13 is a cross-sectional view of the golf club head similar to FIG. 3 showing yet another embodiment of the present invention where the weight chamber is connected to an upper wall during insertion of the weighted and filler materials.

Referring to FIG. 13, the golf club head 350' is similar to the golf club head 350 shown in FIG. 12, and similar elements have the same number followed by a prime symbol. The chamber 354' extends from the upper wall 352' and the upper wall further defines an aperture 370 through which the filler and weighted materials can be inserted. A closure member 372, as discussed above, can be used to close the aperture 370. The chamber 354' can also be filled only by the aperture in the upper wall, while the sole plate 360' and the cap 358' have no aperture. In another embodiment any of the walls of the chamber can be formed with an aperture through which the weighted and filler materials can be inserted. Furthermore, an aperture through the upper, lower, front, toe, heel and rear walls can be used to fill the chamber by using a tube or other apparatus as discussed above.

While it is apparent that the illustrative embodiments of the invention disclosed herein fulfill the objectives stated above, it is appreciated that numerous modifications and other embodiments may be devised by those skilled in the art. For example, the present invention contemplates having a plurality of sole plates available with different configurations of the chamber or number of chambers thereon which can be attached to the body and tested with the weighting and filler material, so that a club head can be customized quickly and easily. Therefore, it will be understood that the appended claims are intended to cover all such modifications and embodiments which would come within the spirit and scope of the present invention.

We claim:

1. A golf club head, wherein the head comprises:

a hollow interior cavity therein;

a first support wall;

a second wall coupled to and extending from the first, support wall into the interior cavity, the second wall defining a chamber therein;

a first flowable material disposed within the chamber, the first material having a first weight; and a second flowable material disposed within the chamber, and the second material having a second weight less than the first weight;

wherein the second flowable material has a fluid state and a set state, wherein in the set state the second material secures the first material within the chamber.

2. The golf club head of claim 1, wherein the first material is disposed within a first section of the chamber and the second material is disposed within a second, distinct section of the chamber.

3. The golf club head of claim 2, wherein the second material in the second section of the chamber is disposed between the first material in the first section of the chamber and the support wall.

4. The golf club head of claim 3, wherein the first section is a first layer and the second section is a second layer.

5. The golf club head of claim 4, further including a plurality of layers of the first material and a plurality of layers of the second material, wherein the layers of the first material alternate with the layers of the second material.

6. The golf club head of claim 3, wherein the support wall is a sole of the head.

7. The golf club head of claim 1, wherein the support wall further defines an aperture extending from the interior surface of the support wall to the exterior surface of the support wall, the aperture providing a conduit into the chamber.

8. The golf club head of claim 7, further including a plug disposed in the aperture.

9. The golf club head of claim 7, further including a fastener disposed in the aperture.

10. The golf club head of claim 7, wherein the first material is formed of a plurality of particles and the diameter of each particle is less than the diameter of the aperture.

11. The golf club head of claim 1, wherein the support wall is a lower wall, and the golf club head further includes an upper wall, a front wall, a rear wall, a toe wall, a heel wall, and a centerline disposed substantially midway between the toe wall and the heel wall.

12. The golf club head of claim 11, wherein the chamber is centered with the centerline.

13. The golf club head of claim 11, wherein the chamber is disposed between the toe wall and the centerline.

14. The golf club head of claim 11, wherein the chamber is disposed between the heel wall and the centerline.

15. The golf club head of claim 11, wherein the chamber is disposed adjacent the rear wall of the club head.

16. The golf club head of claim 11, further including three chambers, wherein at least one chamber contains the first material and the second material.

17. The golf club head of claim 16, wherein at least two of the chambers include the first material and the second material.

18. The golf club head of claim 16, wherein the first chamber is disposed between the heel wall and the centerline, the second chamber is centered with the centerline, the third chamber is disposed between the toe wall and the centerline.

19. The golf club head of claim 1, wherein the chamber has a cylindrical shape.

20. The golf club head of claim 1, wherein the chamber has an arcuate shape.

21. The golf club head of claim 1, wherein the first material is selected from the group consisting of tungsten, copper, aluminum, a non-toxic metal, and a mixture thereof.

22. The golf club head of claim 1, wherein the second material is selected from the group consisting of adhesive, glue, caulking material, a thermosetting resin, a thermoplastic resin, epoxy, and a mixture thereof.

23. The golf club head of claim 1, wherein the interior cavity surrounding the second wall is filled with a foam material.

24. A golf club head defining an interior cavity therein, wherein the head comprises:

a first support wall;

a second wall coupled to and extending from the first, support wall into the interior cavity, the second wall defining a chamber therein;

a first flowable material disposed within a first section of the chamber, the first material having a first weight; and a second material disposed within a second, distinct section of the chamber, the second material having a fluid state and a set state, wherein in the set state the second material secures the first material within the first section of the chamber, and the second material having a second weight less than the first weight.

25. A golf club head comprising:

a body formed of an upper wall, a front wall, a rear wall a toe wall, and a heel wall defining an interior cavity therein and a bottom opening;

a lower wall connected to the body in the opening for closing interior cavity, the lower wall having a side wall member extending therefrom, a top wall disposed on the free end of the side wall member to define a chamber therein, and the lower wall further defining an aperture for providing a conduit into the chamber;

a first flowable material disposed within a first section of the chamber, the first material having a first weight and being formed of a plurality of particles;

a second material disposed within a second section of the chamber, the second material having a fluid state and a set state, wherein in the set state the second material secures the first material within the first section of the chamber, and the second material having a second weight less than the first weight; and a closure member disposed within the aperture.

26. The golf club head of claim 1, wherein the chamber is only a single chamber.

27. The golf club head of claim 1, wherein the chamber is substantially vertically elongated.

28. The golf club head of claim 26, wherein the chamber has a cylindrical shape of uniform diameter.

* * * * *